US012055350B2

(12) United States Patent
Provenziani et al.

(10) Patent No.: US 12,055,350 B2
(45) Date of Patent: Aug. 6, 2024

(54) VERTICAL HEAT EXCHANGER

(71) Applicant: Wieland Provides Srl, Latina (IT)

(72) Inventors: Franco Provenziani, Latina (IT); Paolo Pitrelli, Latina (IT); Paolo Donello, Latina (IT)

(73) Assignee: WIELAND PROVIDES SRL, Latina LT (IT)

( * ) Notice: Subject to any disclaimer, the term of this patent is extended or adjusted under 35 U.S.C. 154(b) by 291 days.

(21) Appl. No.: 17/279,164

(22) PCT Filed: Oct. 15, 2019

(86) PCT No.: PCT/IB2019/058776
§ 371 (c)(1),
(2) Date: Mar. 24, 2021

(87) PCT Pub. No.: WO2020/079585
PCT Pub. Date: Apr. 23, 2020

(65) Prior Publication Data

US 2021/0396474 A1 Dec. 23, 2021

(30) Foreign Application Priority Data

Oct. 15, 2018 (EP) ..... 18200487

(51) Int. Cl.
*F28D 7/16* (2006.01)
*F28F 9/22* (2006.01)
*F28F 9/24* (2006.01)

(52) U.S. Cl.
CPC ..... *F28D 7/1646* (2013.01); *F28F 9/24* (2013.01); *F28D 7/16* (2013.01); *F28D 7/1669* (2013.01);

(Continued)

(58) Field of Classification Search
CPC .... F28D 7/1646; F28D 7/1669; F28D 7/1676; F28D 7/16; F28D 7/1607; F28F 2009/226
See application file for complete search history.

(56) References Cited

U.S. PATENT DOCUMENTS 2,098,671 A 11/1937 Paget
2,498,145 A * 2/1950 Townsend ..... F28F 9/22 165/158

(Continued)

FOREIGN PATENT DOCUMENTS

CN 1149124 A 5/1997
CN 103063058 A 4/2013
JP H-05231793 A * 2/1992

OTHER PUBLICATIONS

Translation of JPH05231793A entitled Translation-JPH05231793A (Year: 2023).*

(Continued)

*Primary Examiner* — Paul Alvare
(74) *Attorney, Agent, or Firm* — LUCAS & MERCANTI, LLP

(57) ABSTRACT

A heat exchanger is disclosed having a tube bundle, intended to internally receive a first fluid, and a shell with an inlet opening at a first end. The shell allows an internal circulation of a second fluid and is arranged to surround the tube bundle. An inner casing to the shell circumscribes the bundle within a heat exchange chamber so that between the casing and the shell an annular region extending in a continuous way along the length of the bundle is defined. The annular region is in fluid communication with the exchange chamber through an outflow opening obtained at a second end of the inner casing where the latter has a rear wall facing an opening of the shell to outlet the second fluid from the heat exchanger. The inlet and outlet openings are in fluid communication by means of the annular region.

12 Claims, 5 Drawing Sheets

(52) U.S. Cl.
CPC ..... *F28D 7/1676* (2013.01); *F28F 2009/226* (2013.01)

(56) References Cited

U.S. PATENT DOCUMENTS

| | | | | | |
|---|---|---|---|---|---|
| 2,514,894 | A * | 7/1950 | Naab | F02C 7/275 | 165/161 |
| 2,753,954 | A * | 7/1956 | Townsend | F04B 39/16 | 96/417 |
| 2,916,264 | A * | 12/1959 | Rhodes | F28F 9/22 | 165/110 |
| 3,760,870 | A * | 9/1973 | Guetlhuber | B01J 8/067 | 165/158 |
| 5,871,045 | A | 2/1999 | Hirth et al. | | |
| 5,894,883 | A * | 4/1999 | Gentry | F28D 7/0066 | 165/DIG. 402 |
| 2011/0017432 | A1 | 1/2011 | Kulankara et al. | | |
| 2012/0145367 | A1 | 6/2012 | Fujisawa et al. | | |
| 2018/0023897 | A1 * | 1/2018 | Brignone | F28F 9/005 | 165/174 |

OTHER PUBLICATIONS

International Search Report and Written Opinion for Corresponding International Application No. PCT/IB2019/058776 (9 Pages) (Jan. 20, 2020).

International Preliminary Report on Patentability for Corresponding International Application No. PCT/IB2019/058776 (18 Pages) (Sep. 10, 2020).

* cited by examiner

VERTICAL HEAT EXCHANGER

CROSS-REFERENCE TO RELATED APPLICATIONS

This application is a 371 of PCT/IB2019/058776, filed Oct. 15, 2019, which claims the benefit of European Patent Application No. 18200487.9, filed Oct. 15, 2018.

TECHNICAL FIELD OF THE INVENTION

The present invention relates to the field of apparatus for the thermal treatment of fluids, in particular to apparatus suitable for use in industrial conditioning systems.

The present invention relates, more in detail, to a shell and tube heat exchanger, in particular an evaporator, preferably having an overall "vertical" configuration.

BACKGROUND

As known in the technical field, heat exchangers are apparatus that can provide a diversity of constructive variants, for example according to their geometry, compactness, type of process wherein they are used or with respect to the specific heat exchange profile they exhibit under operational conditions.

A particular type of heat exchangers, called shell and tube, typically provides a casing—or shell—within which a bundle of tubes is housed within which a first operating fluid—or process fluid—flows. A second fluid—or service fluid—circulates inside the shell in order to achieve an exchange of thermal energy with the first operating fluid. In the case of evaporators, for example, the service fluid is a refrigerant fluid, at a lower temperature of the process fluid, that evaporates and absorbs heat from the latter which cools.

Typically, the abovementioned exchangers provide a structure which, in assembled and operating condition, develops mainly along horizontal direction, in particular for the arrangement of the shell and the development direction of the tube bundle inside thereof, both in case the exchangers provide a tube bundle totally immersed in the refrigerant fluid (so-called "flooded" type), and in case the feeding of the latter is supplied from above, by means of a distribution system that creates a "rain" over the tube bundle itself (so-called "falling film" type). Leaving refrigerant direction is usually orthogonal to tube bundle development.

The exchangers with the abovementioned configurations are, however, perfectible primarily in terms of efficiency of the heat exchange, overall dimensions, management and operating costs.

BRIEF DESCRIPTION OF THE INVENTION

The technical problem posed and solved by the present invention is therefore to overcome the above described drawbacks, and this is achieved by means of a heat exchanger as defined in claim 1.

In particular, aim of the present invention is to provide a heat exchanger that has high efficiency characteristics and is constructively compact and with reduced overall dimensions.

Further aim of the present invention is to provide a heat exchanger that reduces management and operating costs and decreases the time required for maintenance operations.

Further characteristics of the present invention are defined in the corresponding dependent claims.

The present invention relates to a heat exchanger whose structure has, in a preferred embodiment, an overall vertical configuration. In general terms, the heat exchanger comprises a shell structure and internally a tube bundle, wherein the tube bundle is intended to internally receive a first operating fluid—or process fluid—and has a prevalent extension of development along a longitudinal direction. Preferably said longitudinal direction, in use of the heat exchanger, is a "vertical direction", namely a direction substantially parallel to the direction of the weight force. The shell structure comprises an inlet opening at a first, preferably bottom, longitudinal end, the shell structure being apt to permit a circulation inside thereof a second operating fluid—or service fluid—and is arranged, preferably coaxially, to surround the tube bundle.

In detail, inside the shell structure there is a casing which circumscribes said tube bundle in a heat exchange chamber in such a way that, between the casing and the shell structure, an annular region is defined and extending continuously for the overall length of the tube bundle. Said annular region is in fluid communication with the heat exchange chamber by means of an outflow opening, obtained at a second, preferably top, longitudinal end of said casing. Preferably, the outflow opening presents a flute-beak geometric shape.

Said outflow opening is obtained on the casing in such a way that a rear wall facing an outlet opening of the second operating fluid from the heat exchanger remains defined, said outlet opening being provided by the shell structure at said second, preferably top, longitudinal end. The inlet opening and the outlet opening being in fluid communication by means of said annular region.

Such constructive solution, especially in case of the vertical extension of the shell structure, of the tube bundle inside thereof and of the casing surrounding the latter—in preferred embodiments each presenting a substantially cylindrical shape—is simple, solid and cost-saving. For example, such solution advantageously allows the heat exchanger to be easily approved for operating pressures equal to or greater than 16 bars, provides lightness to the apparatus by making its weight tolerable by industrial floors and has reduced overall dimensions for cooling capacity lower than 1 MW.

In a preferred embodiment, the heat exchanger is configured to operate as an evaporator and the specific positioning of the flute-beak shaped outflow opening, preferably positioned at the top longitudinal end of the casing, allows the service fluid—in this case a refrigerant fluid—to pass through the annular region before exiting from the shell structure.

In this way, the efficiency of the heat exchange is maximized and the chance of direct dragging of liquid refrigerant fluid is significantly reduced, thus avoiding unwanted bypasses of mass flow not involved in the energy exchange and which could compromise the correct operation of devices connected downstream of the exchanger, such as compressors.

Furthermore, advantageously, the heat exchanger according to the present invention, operating as an evaporator, allows to use as tube bundle the state of the art of the technical tubes for boiling and to reduce the overall dimensions of the conditioning apparatus. Considering, for example, an assembled group comprising an evaporation unit according to a preferred embodiment of the present invention, a condensing unit, a compression unit and an electrical panel, the overall size of the assembled group is such that it can pass through industrial doors and freight elevators. Moreover, in case an overall vertical configuration of the heat exchanger is carried out, it is even possible to reduce the amount of service fluid required for its operation. For example, the load of refrigerant fluid required for the operation of the evaporator is very low, such as to even allow the exchanger to be filled 10%-20% in height with respect to the net development of the tube bundle. This height could, ideally, even be lower and almost null, providing operation with the only amount of liquid refrigerant suspended in the heat exchange chamber.

Other advantages, features and use modes of the present invention will result evident from the following detailed description of some embodiments, shown by way of example and not with limitative purpose.

BRIEF DESCRIPTION OF THE FIGURES

The figures of the enclosed drawings will be referred to, wherein.

DETAILED DESCRIPTION OF PREFERRED EMBODIMENTS

The present invention will be hereinafter described referring to the abovementioned figures.

Unless otherwise apparent, or stated, directional references o terms, such as "upper", "lower", "top", "bottom", "right", "left" etc., are intended to be relative to the orientation of a particular embodiment of the invention.

In general terms, the present invention relates to a heat exchanger, of the shell and tube type, or so-called "Shell and Tube", which uses as first operating fluid—or process fluid—preferably water (pure or in solution) and as second operating fluid—or service fluid—preferably a refrigerant fluid, such as for example hydrofluorocarbons (HFC), hydrofluoroolefins (HFO) or fluid with similar properties.

Figure 1:
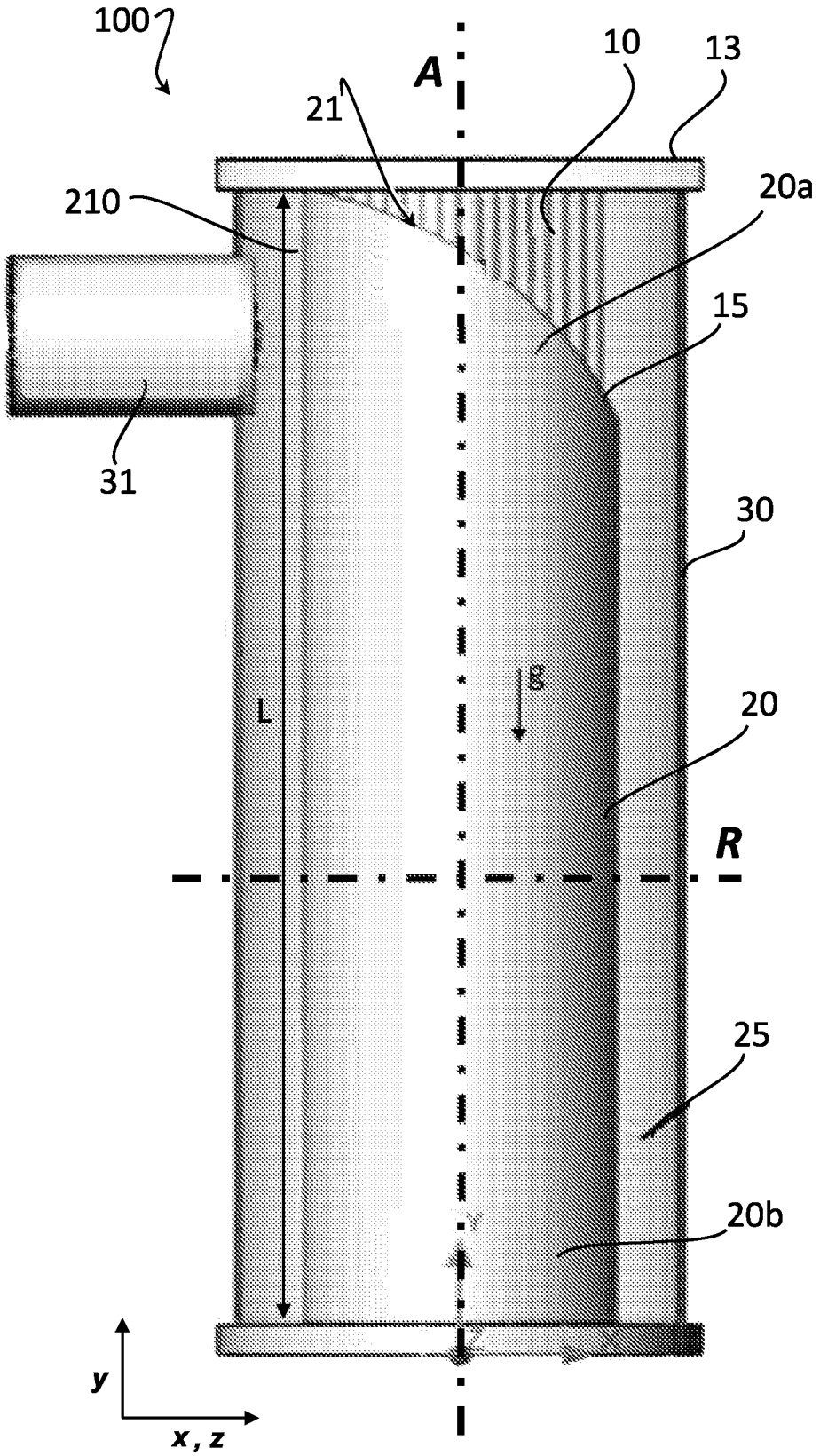
FIG. 1 shows a lateral view of a preferred embodiment of a heat exchanger according to the present invention, wherein the shell structure is transparently shown.
Figure 5A:
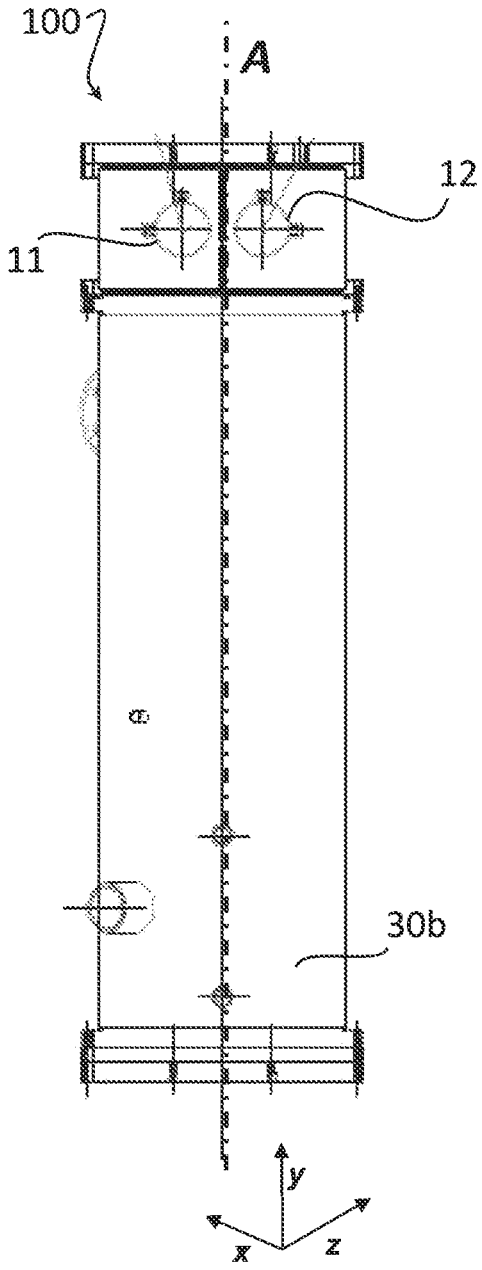
FIGS. 5A and 5B show two lateral views with different orientation of a preferred embodiment of the heat exchanger in an evaporator configuration.
Figure 5B:
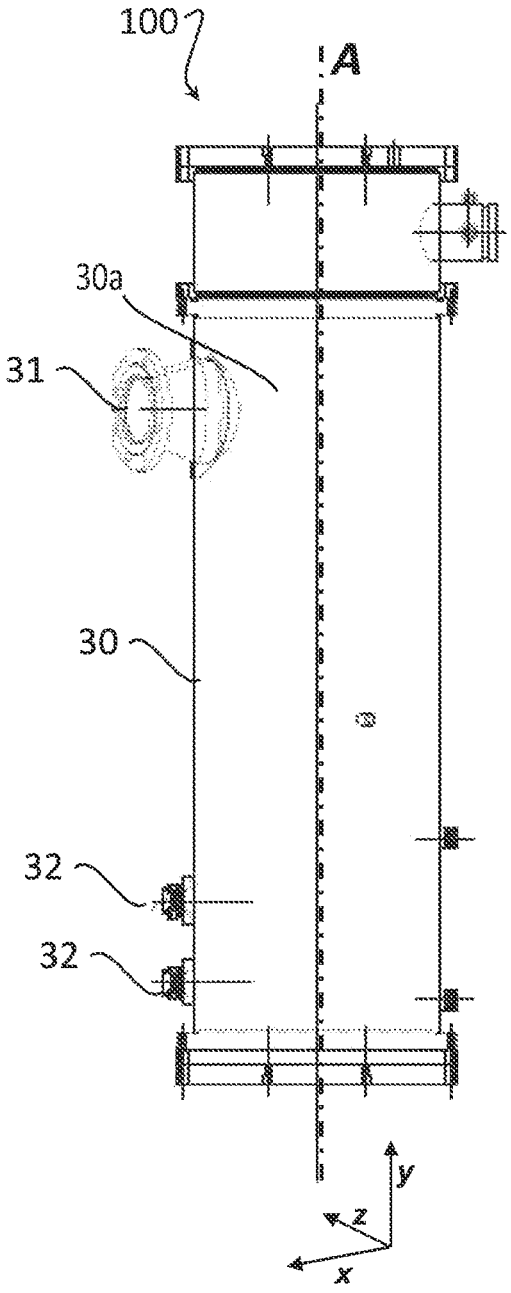

Firstly, referring to FIG. 1, an overview of a preferred embodiment of a heat exchanger 100 according to the present invention is illustrated. Preferably, the heat exchanger 100 is an evaporator wherein, as known, a refrigerant fluid contacting (or, in concurrence, by means of convection phenomena) the tube bundle, removes thermal energy from the process fluid which flows inside thereof, cooling it. A schematic representation of a preferred embodiment of an evaporator according to the present invention is shown in FIGS. 5A and 5B where the inlet opening and the outlet opening of the service fluid inside the exchanger 100 are denoted, respectively, by the reference 32 and 31, while the inlet and the outlet of the exchanger 100 of the first operating fluid respectively by reference 12 and 11.

The exchanger 100 comprises a tube bundle, denoted by reference 10, intended to internally allow a circulation of the first operating fluid through the aforementioned corresponding openings 11, 12. As shown with further reference to the preferred embodiment of FIGS. 2 and 4, the tube bundle 10 has preferably a prevalent development extension along a longitudinal direction A which is substantially parallel to the weight-force direction, denoted by the arrow g. In other words, the tube bundle 10 may preferably present a substantially vertical extension, in condition of exchanger 100 assembled or operating, namely substantially perpendicular with respect to a support plane—or surface—of the exchanger itself.

It is to be intended that further embodiments may provide for the heat exchanger 100 to be mounted, positioned or arranged horizontally under operating condition.

In any case, the overall configuration of the heat exchanger 100 being that the outflow direction of the second operating fluid is substantially parallel to the longitudinal direction A of development of the tube bundle 10. One (or both the) terminal end of the tube bundle 10 engages a (corresponding) tube plate 13 at the head of the exchanger 100 in order to supply said tube bundle 10 with the process fluid, components available for the skilled person and that will not be further deepen.

The exchanger 100 further comprises a shell structure 30, or shell, apt to allow a circulation of the second operating fluid inside thereof. Preferably, such shell 30 is coaxially placed to surround said tube bundle 10. Furthermore, the shell 30 is watertight and suitably dimensioned in order to operate at design pressures. As shown in the illustrated examples, the shell 30 hence extends in the same longitudinal direction A of development of the tube bundle 10 which is contained inside thereof.

Basically, considering a reference system constituted by a tern of reciprocally orthogonal axes, respectively denoted in the illustrated examples by x, y and z, the heat exchanger 100 and, in particular, its shell 30 and the tube bundle 10, extend according to the longitudinal direction A, parallel to the direction y, the latter direction being orthogonal to the plane including the directions x and z.

During operation as an evaporator, farther referring to FIGS. 5A and 5B, the shell 30 bears, at a first, preferably bottom, longitudinal end 30*b*, in particular in proximity of—or at—a lower portion thereof, the inlet opening 32 for the refrigerant fluid. At an opposite second, preferably top, longitudinal end 30*a*, in particular in proximity of an upper portion, an outlet opening 31 from the exchanger 100 for the refrigerant fluid. The refrigerant fluid inletting in the shell 30, typically in a liquid or biphasic (liquid and vapor) form, during the heat exchange occurring with the fluid which flows inside the tube bundle 10, evaporates and ascends upwards to said outlet opening 31 along the san1e longitudinal development direction A of the tube bundle 10.

According to alternative embodiments, the inlet of the service fluid inside the exchanger 100 may occur through a delivery system and from positions—not shown in the Figures—different from the aforementioned ones.

For example, the second operating fluid may be sprayed from a position, or height, intermediate with respect to the longitudinal ends of the shell 30, reaching the tube bundle 10 at specific altitudes, in order to supply the heat exchanger with the latter partially by falling, precipitating, and partially by dragging during its upward evaporation. In similar configurations, the exchanger 100 may provide internally with a spray supply system which comprises supply means, for example, a cylindrical or annular collector, by means of which the service fluid is locally sprayed in regions at different altitudes (both in terms of positions along longitudinal direction A, i.e. in parallel to the y-axis, and along radial direction R, i.e. comprised in the xy-plane) of the tube bundle 10.

Further embodiments may provide for example a flooding of the heat exchanger 100, wherein the service fluid enters from the shell 30 and is distributed by gravity and/or by an annular distributor, filling the bottom of the exchanger in predetermined amounts.

Referring to the FIGS. 1-4, inside the shell structure 30, in particular entirely inside it, a casing 20 circumscribes the tube bundle 10 in a heat exchange chamber 15. The casing 20 is interposed between the shell 30 and the tube bundle 10 and allows to define, between them, an annular region 25 which extends in a continuous way along the length L of said bundle 10. According to a preferred embodiment of the exchanger 100, said annular region 25 has an extension along a radial direction R, orthogonal to the longitudinal development direction A of the tube bundle 10, constant along the length L of the latter. The casing 20 may be made for example as a carved tubular element or a calendered carved sheet. Even more preferably, the shell structure 30, said casing 20 and the tube bundle 10 are coaxially placed and have a substantially cylindrical shape.

Figure 2:
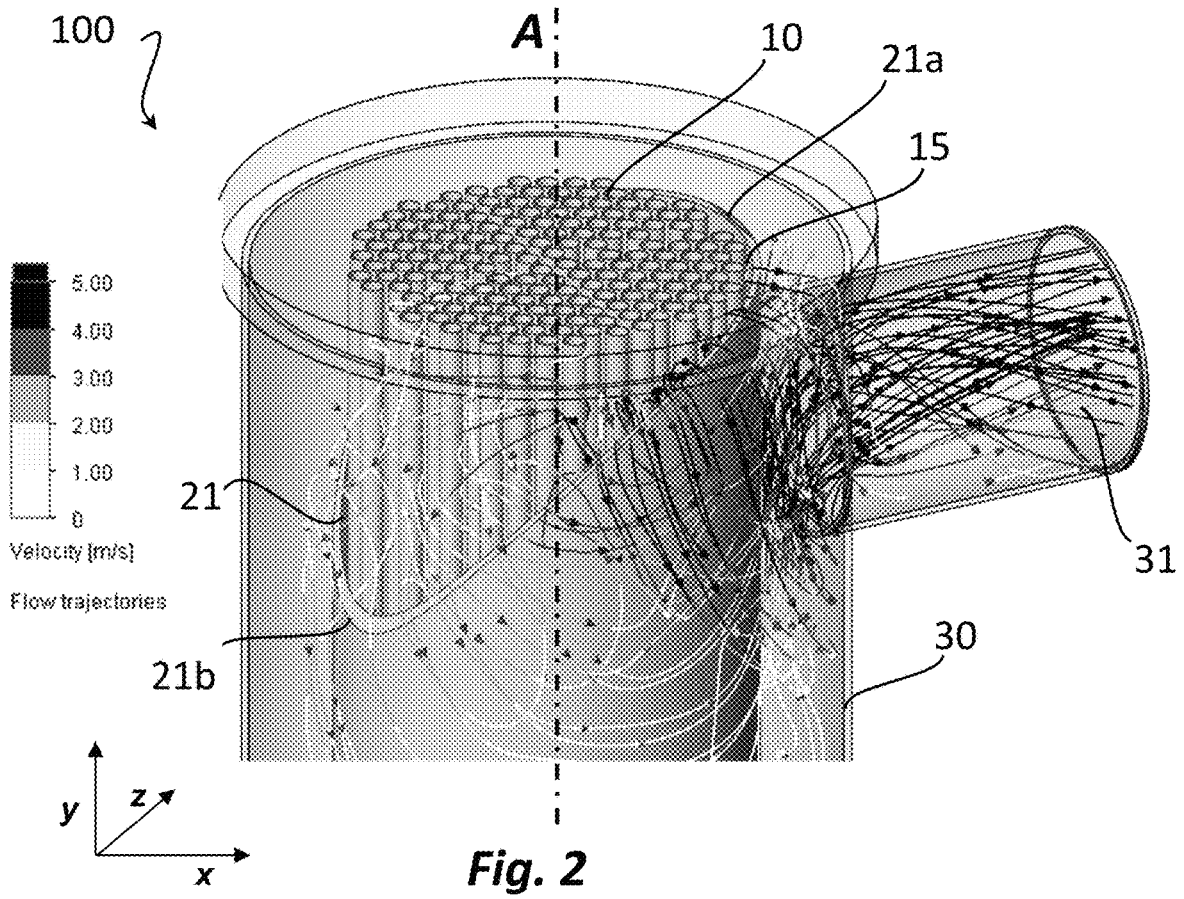
FIG. 2 shows an axonometry view of an upper portion of the heat exchanger of FIG. 1 and the flowlines of the second operating fluid—or service fluid—outleting thereby.

With particular reference to FIG. 2, the annular region 25 is in fluid communication with said heat exchange chamber 15 by means of an outflow opening 21, obtained at said second, preferably top, longitudinal end 20*a* of the casing 20. As shown, such outflow opening 21 defines a rear wall 210 of the casing 20 which faces an outlet opening 31 of the second operating fluid from the heat exchanger 100. Said outlet opening 31 is provided by the shell 30 at the same second, preferably top, longitudinal end 20*a* wherein the abovementioned outflow opening 21 is obtained. Preferably, the casing 20 further has one or more through openings placed in proximity of the first, preferably bottom, longitudinal end 20*b*, opposite with respect to the second, preferably top, longitudinal end 20*a* provided with said outflow opening 21, that will be discussed later. In other words, the outflow opening 21 is preferably defined as an oblique cut of the inner casing 20 so as the latter comprises a rear wall 210 at its second, preferably top, longitudinal end 20*a* facing said outlet opening 31. Preferably, said rear wall 210 is a curved wall facing the outflow opening 21.

The outflow opening 21 has, preferably, an overall geometric shape of a flute-beak, that is a shape wherein the profile of the opening has, substantially, an elliptic geometry. In this case, the ends of the major axes of the ellipse attain in an upper relative position 21*a* and a lower relative position 21*b* with respect to the extension of the casing 20, wherein the extension of said rear wall 210 is proportional to the height difference between said two relative positions 21*a*, 21*b*. In particular, the extension of the rear wall 210 increases as said height difference increases. The greater is the extension of the rear wall 210 the greater is the passage section for the fluid that exits from the heat exchange chamber 15.

Figure 3:
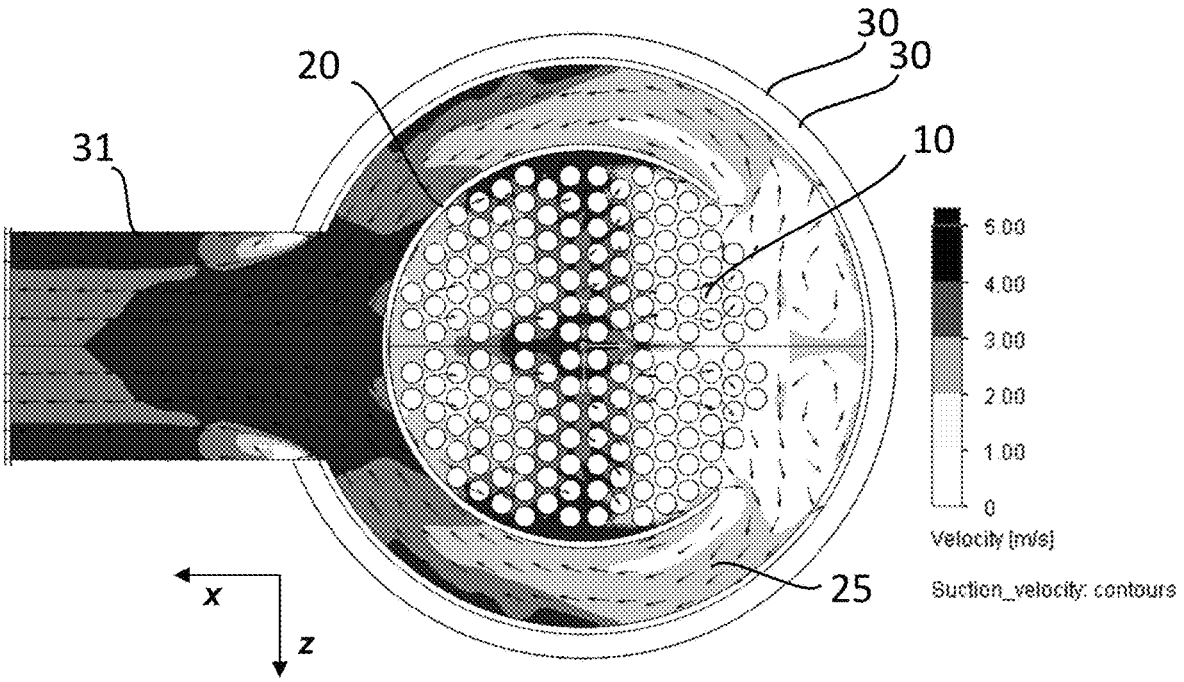
FIG. 3 shows the flowlines of the second operating fluid in a section along a transversal plane of the exchanger of FIG. 1 at the outlet opening of the shell structure.
Figure 4:
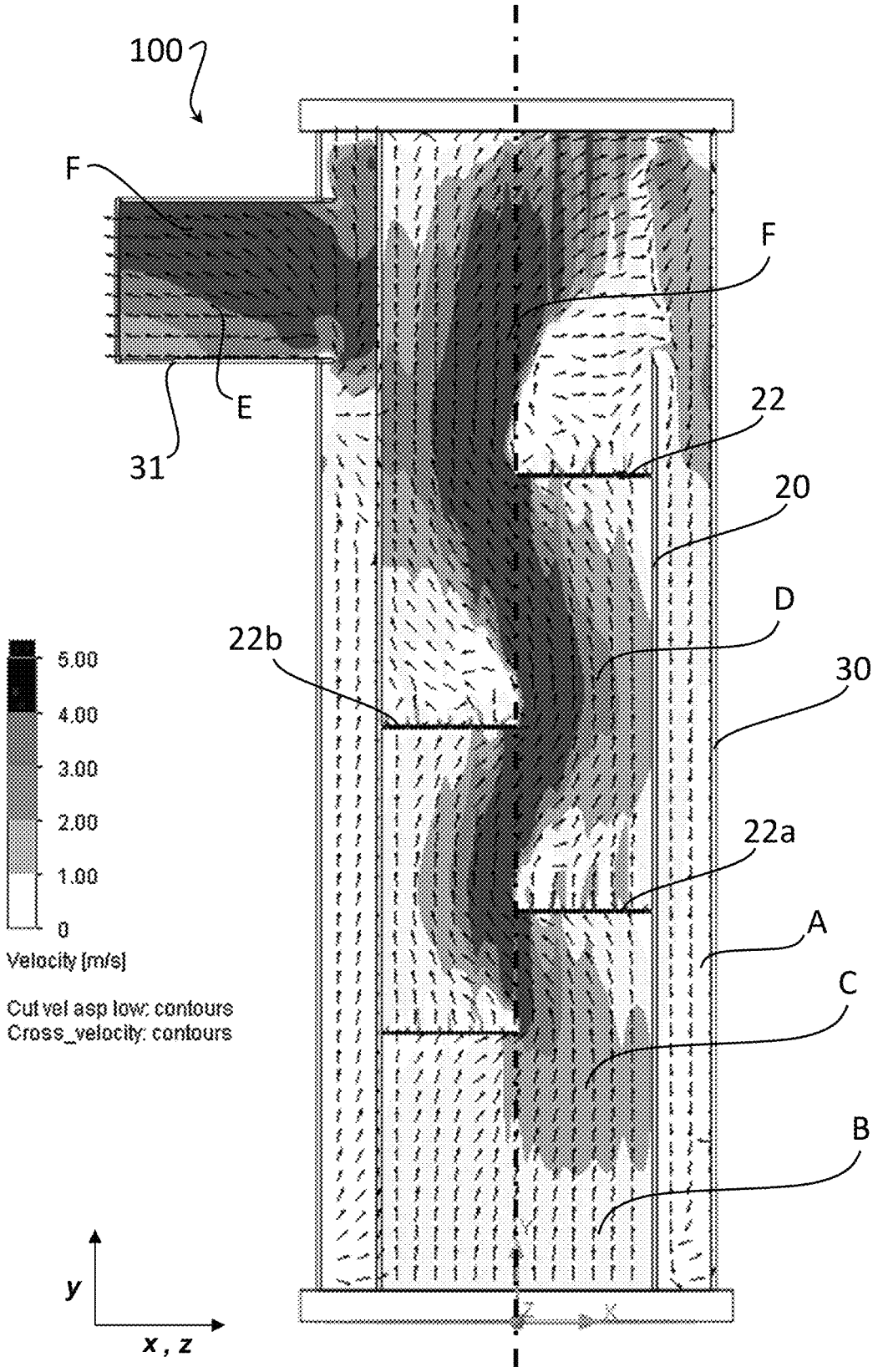
FIG. 4 shows the flowlines of the second operating fluid in a section along a longitudinal plane of the heat exchanger of FIG. 1.

The specific positioning and orientation of the outflow opening 21, allows the second operating fluid exiting from the heat exchange chamber 15 to pass through the annular region 25 in a substantially transversal plane with respect to said longitudinal direction A, before exiting from said shell structure 30. The arrows shown in FIGS. 2, 3 and 4 represent the flowlines associated to the second operating fluid exiting from said outflow opening 21 and it will be appreciated how, hence, such opening 21 allows the second operating fluid to pass circumferentially along the annular region 25, canalizing it towards the outlet opening 31 from the shell 30.

In other words, for example in the exchanger 100 configured as evaporator, the refrigerant fluid which evaporates from the heat exchange chamber 15, is not directly sucked from the outlet opening 31 but is deviated from the casing 20 itself, exiting from the outflow opening 21 obtained at a longitudinal end, distributing itself in the annular region 25. Preferably, the outflow opening 21 is obtained at the top longitudinal end 20*a* and, in combination with or as an alternative to, the abovementioned one or more through openings are provided from the casing 20 at the bottom longitudinal end 20*b*.

Advantageously, the presence of such outflow opening 21 reduces the chance of direct dragging of refrigerant fluid, avoiding undesired bypasses of mass flow of refrigerant fluid which, in addition to the fact that it is not involved in the heat exchange with the tube bundle, would result to be harmful in case it was processed by further units connected downstream to the exchanger 100, such as for example a compressor. Accordingly, the annular region has also the technical effect of being a sort of collector for the refrigerant fluid in excess. In other embodiments of the exchanger 100, further adjustments—not shown in the Figures—may be implemented in order to avoid the dragging of service fluid in liquid form, and provided at the outflow opening 21. For example, deflector elements, such as lamination sheets, may be suitably placed onto the wall of the casing 20, in particular onto the wall that faces the heat exchange chamber 15, in such a way to interrupt any fluid rivulets that flow over it. As an alternative to or in combination with, known separator devices may be provided, such as the so-called demister, comprising finned packs (typically printed or die-cast), generally made of compatible plastic material, which work as separator between liquid phase and gas phase. The liquid possibly collected, may be drained downwards to the annular region 25. Other embodiments may provide the use of heat exchanger (serpentine or helix or tube bundle type) positioned at the suction opening so as to dry the liquid approaching the suction (intercooler).

Moreover, the presence of the casing 20 allows to provide further supplying mode of the second operating fluid inside the exchanger 100. For example, the casing 20 may provide with a slotted or drilled connection arranged in an intermediate position with respect the longitudinal ends of the tube bundle 10, in order to inlet the mass flow of refrigerant (a rate or the total) at a certain height of the tube bundle 10.

As previously anticipated, the casing 20 has preferably one or more through openings at a first, preferably bottom, longitudinal end 20*b*. They may be realized according to different configurations or shapes and they allow the second operating fluid to enter the annular region 25 to pass through the casing 20 and to reach the heat exchange chamber 15, for its distribution in liquid form. Such through openings may be, for example, crenulations and/or holes and/or slots and/or perimeter cuts of the casing 20.

The casing 20, hence, further acts as annular distributor for the second operating fluid and as a gas/liquid separator.

In particular, as distributor the casing 20 operates both during the refrigerant fluid inlet phase toward the heat exchange chamber 15 and during the suction phase of the evaporated fluid. In this latter case, it distributes and deflects the evaporated flow from a direction A of evaporation primarily longitudinal inside the heat exchange chamber 15, to a transversal direction Rat the outlet opening 31 from the exchanger 100, by virtue (of the specific orientation) of the abovementioned outflow opening 21.

As gas/liquid separator, preferably the casing 20 allows to the service fluid in biphasic form and radially entering the shell 30, to impact onto the wall of the shell which faces the annular region 25 and to divide it in two phases.

The liquid phase falling by gravity reaches the bottom of the exchanger 100 and, crossing the abovementioned through openings, enters the heat exchange chamber 15. The gas phase ascends in the annular region 25 toward the outlet opening 31, not being involved in the heat exchange and being directly sucked outside the exchanger 100.

As best shown in FIGS. 1 and 4, the inlet opening 32 and the outlet opening 31 of the shell structure 30 are in fluid communication by means of said annular region 25. In this way, the gas phase can directly reach the outlet of the shell-side avoiding to be overheated inside the heat exchange chamber 15.

Advantageously, the annular region 25 may hence receive an amount of the second operating fluid considerably minor with respect to the volumes typically used. In particular, the amount of refrigerant necessary for the evaporator to operate is very low, comprised between about 10% and 20% of the extension of the tube bundle 10 along the longitudinal direction A. Theoretically, such amount may be almost null, with the solely amount of refrigerant fluid in suspension. This would be possible operating the control to the opening of the lamination valve by the temperature measurement feedback of the subcooled of the liquid line. In such a way, being the level of the second operating fluid inside the exchanger 100 very low, the free volume thereof not flooded may be used as receptor for liquid (at conditions of partialisation of the workload if the dragging velocity of the ascending fluid towards the outflow opening 31 are too high at the nominal load) Moreover, advantageously, the presence of a casing 20 which encases the tube bundle 10 inside a heat exchange chamber 15, eases the canalization of the fluid along a predetermined path inside the exchanger 100. Again, referring to FIG. 4, it is shown a section along the longitudinal direction A of the exchanger 100, wherein the arrows show the path of the flowlines of the second operating fluid, inside the annular region 25 and the heat exchange chamber 15.

The regions denoted by the letters A, B, C, D, E, F, each refers to a corresponding velocity profile of the second operating fluid, that is the profile A comprised in the velocity range about from 0 to 1.00 m/s, the profile B comprised in the velocity range about from 1.00 to 2.00 m/s, the profile C comprised in the velocity range about from 2.00 to 3.00 m/s, the profile D comprised in the velocity range about from 3.00 to 4.00 m/s, the profile E comprised in the velocity range about from 4.00 to 5.00 m/s, the profile F comprised in the velocity range about from 5.00 to any greater value. Furthermore, in the shown example, inside the heat exchange chamber 15 deflecting means 22 of the flow of the second operating fluid is visible, and which will be shortly discussed in more details.

The casing 20 canalizes the service fluid which exchanges heat, defining the passage section thereof inside the exchanger: in particular, the refrigerant fluid, which evaporates exchanging heat with the tube bundle, circulates exclusively within the internal casing, passing through the tube bundle at a predetermined passage section.

In the evaporator, such passage section has such a size as to ensure the depression of the refrigerant assures the dragging of the refrigerant, leading the latter to a high ascension speed towards to the outflow opening 21. For example, experimental data to which the abovementioned velocity profiles refer, as indicated by the flowlines shown in FIGS. 2, 3 and 4, indicate that for a heat exchanger according to the present invention which cooperates with compressors of common size, in particular of nominal powers comprised between 250 kW and 350 kW, the ascension speed is about 5 m/s in condition of nominal mass flow. In this way, it is possible to achieve a speed of at least 1 m/s under a partialisation of 20%—considered as inferior limiting value to obtain dragging of the refrigerant liquid. Thus, the refrigerant fluid supplied is delivered towards the upper longitudinal end 20*a* of the exchanger 100, both due to the suction provided to the outlet opening 31 by means of a compressor, and also due to convection, entirely involving the tube bundle 10 and avoiding regions poorly supplied by the refrigerant fluid.

As anticipated, in a preferred embodiment, the casing 20 internally comprises deflecting means 22 of the flow of the second operating fluid, arranged in transversal direction R with respect to said longitudinal direction A which, preferably, are further configured to perform a support function for the tube bundle 10. They may be arranged in such a spatially way as to be proportional to the local vacuum fraction inside the heat exchange chamber 15, or equally spaced to each other. In any case, as mentioned, they give a component of velocity to the second operating fluid, which component is substantially perpendicular to the development direction A of the tube bundle 10, in such a way as the latter being crossed as much as possible by the second operating fluid (cross flow).

The deflecting means may be used, in some embodiments, even as integrated variant of supply/distribution means of the second operating fluid. Said fluid, for example a refrigerant fluid, in this case may preferably be spread over them, partially falling by gravity and supplying the portion of tube bundle below, and partially evaporating immediately. Naturally, different supply modes of the second operating fluid may be implemented by means of the deflecting means, for example spray jet or other known devices.

Preferably, operating modes and arrangement of the supply means of the second operating fluid is such as to synergistically take advantage of the evaporation of the latter at the first, preferably bottom longitudinal end 20*b* of the exchanger 100 and its dragging along the longitudinal direction A up to the length of the casing 20. For example, the supply means may be placed at different levels and/or at intermediate heights along the longitudinal direction A, in particular providing an inlet of the second operating fluid directly inside the heat exchange chamber 15. Said positioning may be attained, for example, at a height equal to ⅓ with respect to the length L of the tube bundle 10, starting from the bottom longitudinal end 20*b* of the exchanger 100.

According to such embodiment, said inlet may be for example provided by the casing 20 by means of one or more dedicated openings and obtained onto the wall thereof. In any case, preferably, the supply means is arranged at the deflecting means or directly provided by the latter as previously mentioned.

Differently from the heat exchangers so-called "falling film" and flooded type, a supply system of the second operating fluid, in particular of the refrigerant fluid, which makes use of supply means arranged at intermediate height along the longitudinal direction A, allows to advantageously achieve an "autoregulation" of the distribution of the second operating fluid, in particular of the refrigerant fluid. Such configuration allows to achieve operating conditions wherein the amount of liquid and gas phase that participates in the heat exchange is balanced autonomously, minimizing regions void of fluid inside the chamber 15 along the tube bundle 10 and thus optimizing the overall efficiency of the apparatus.

In general terms, said deflecting means may moreover be implemented according to multiple geometries, for example may be single-element, double-element or even disc or ring shaped. Preferably, the deflecting means comprises one or more plate-like elements 22—or diaphragms—provided with a plurality of first openings configured to be crossed by said tube bundle 10. They may be filled, that is having said first openings solely where they are crossed by the tube of heat exchange, or have second openings, for example holes or slots, distributed in random order between said first openings. Advantageously, said second openings ease the passage of the second operating fluid in the exchange chamber 15—increasing the free area and reducing load losses—and/or allow the liquid fluid to be drained, thus realizing a falling distributor, in case the fluid supply is placed over it or, in any case, whereas a liquid fluid supplied in a different way is accumulated.

In a preferred embodiment, the deflecting means 22 occupies a circular sector of a transversal section of the casing 20 along the longitudinal direction A, preferably occupying a semi-circular sector of the casing 20. In the shown example, the deflecting means 22 is sequentially arranged along said longitudinal direction A, in such a way as consecutive deflecting means 22*a*, 22*b* lies on opposite half-planes with respect to a plane orthogonal to them and passing through the longitudinal direction A. As previously mentioned, the positioning with respect to the development of the casing 20 of the deflecting means 22, which may be fixed by anchoring to the wall of the casing 20 that faces towards the heat exchange chamber 15, is properly chosen depending on the load condition of the exchanger 100.

Advantageously, the heat exchanger 100 may even operate as condenser, for example reversing the refrigerant circuit and thus using the (outlet 31) opening at the second, preferably the top longitudinal end 20*a* as inlet of the overheated refrigerant delivered from the compressor, and the first, preferably the bottom connection (the same inlet opening 32 used for the evaporator or another one arranged for this purpose) as outlet of the subcooled liquid.

Again, the volume of the annular region 25 defined between the casing 20 and the shell 30, may be used to receive a so-called flash tank, in order to increase the system efficiency. Advantageously, the present invention allows to implement a flash tank inside the exchanger 100, contrary to the known exchangers which are typically provided with it externally, therefore achieving an integrated solution with minimum overall dimensions.

Figure 6A:
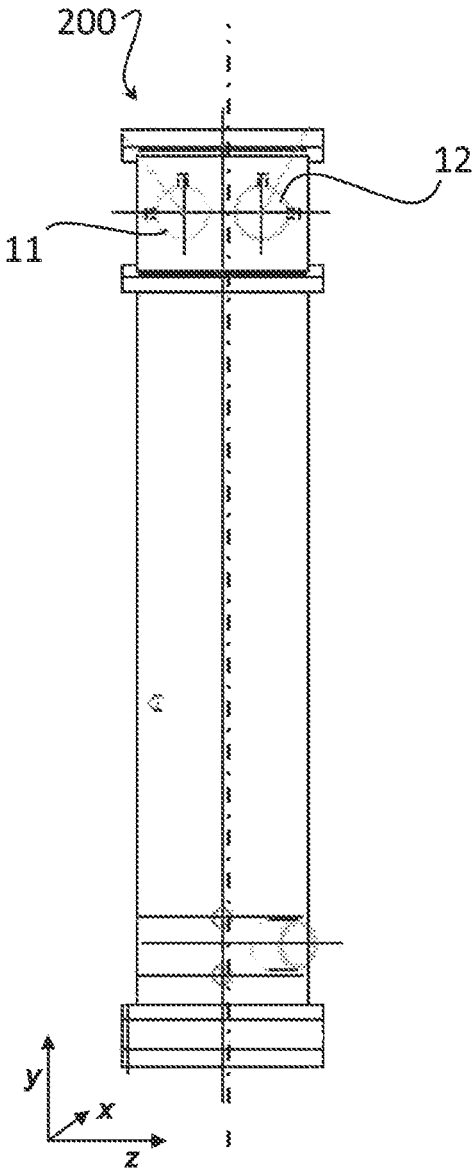
FIGS. 6A and 6B show two lateral views with different orientation of a preferred embodiment of the heat exchanger in a condenser configuration.
Figure 6B:
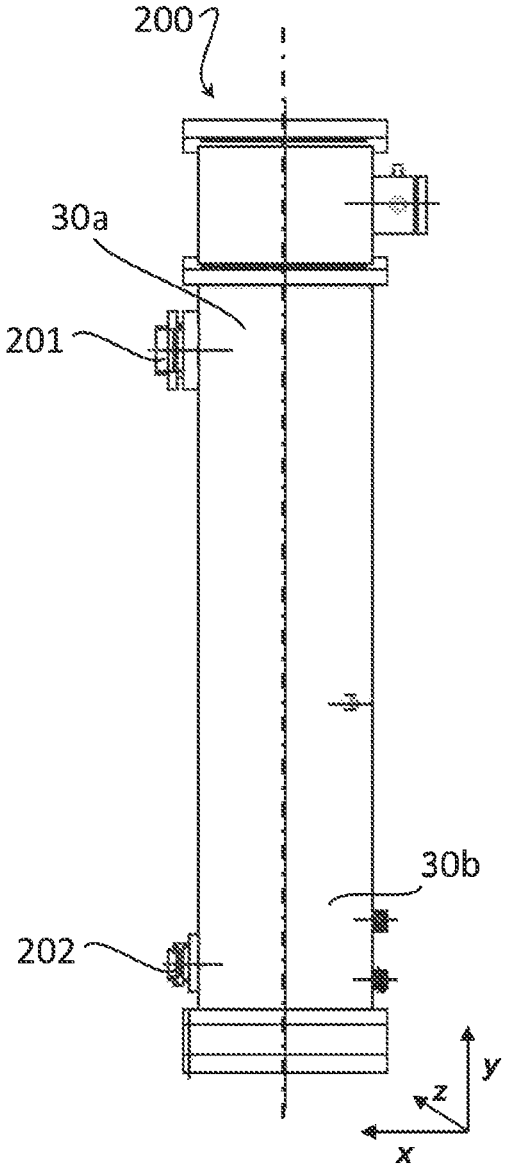

Referring to FIGS. 6A and 6B, the aforementioned "vertical" configuration is also suitable to realize a condenser, globally denoted by reference 200. In this case, the tube bundle 10 is directly inserted within the shell 30 of the heat exchanger. The inlet of the refrigerant (compressor delivery flow), through the opening 201, is arranged at top longitudinal end 30*a* and the refrigerant gas, preferably deflected by the deflecting means, condenses through the tube bundle 10. The condensed fluid (liquid) accumulated in proximity of a base portion 30*b* of the condenser, subcooling, then exits from the intended connection.

The present invention has been so far described by referring to preferred embodiments. It is to be meant that each of the technical solution implemented in the preferred embodiments, above described by the way of a non-limiting example, may be advantageously and differently combined together, in order to achieve other embodiments, which belong to the same inventive core and, however, falling within the scope of the claims reported hereinafter.

The invention claimed is:

1. A heat exchanger comprising:

a tube bundle configured to internally receive a first operating fluid, said tube bundle having a prevalent extension of development along a longitudinal direction, a shell structure having a first longitudinal end and an opposite, second longitudinal end, said shell structure further comprising an inlet opening at the first longitudinal end, said shell structure being configured to allow a circulation inside thereof a second operating fluid, said shell structure being arranged to surround said tube bundle, wherein an inner casing to the shell structure circumscribes said tube bundle within a heat exchange chamber in such a way that between said casing and said shell structure is defined an annular region extending in a continuous way along the length of said tube bundle, said inner casing having a first longitudinal end proximal to said first longitudinal end of said shell structure, and a second longitudinal end proximal to said second longitudinal end of said shell structure, wherein said annular region is in fluid communication with said heat exchange chamber through an outflow opening obtained at the second longitudinal end of said casing, said outflow opening having opposing, upper and lower ends, said upper end of said outflow opening being proximal to said second longitudinal end of said shell structure, and said lower end of said outflow opening being distal to said second longitudinal end of said shell structure, and said outflow opening being defined by a perimeter extending in a downward slope from said upper end of said outflow opening to said lower end of said outflow opening thereby asymmetrically exposing said tube bundle to said annular region, wherein at said second longitudinal end the inner casing comprises a rear wall starting at said upper end of said outflow opening, said rear wall facing an outlet opening of the second operating fluid from the heat exchanger, said outlet opening being provided by said shell structure at said second longitudinal end, wherein said second operating fluid is allowed to enter the shell structure to impact onto a wall of said casing facing the annular region whereby gas phase and liquid phase of the second operating fluid are separated, the inner casing being further provided with one or more through openings at the first longitudinal end, and wherein said inlet opening and said outlet opening are in fluid communication by means of said annular region.

2. The heat exchanger according to claim 1, wherein said annular region has an extension in a radial direction orthogonal to said longitudinal direction constant along the length of said tube bundle.

3. The heat exchanger according to claim 1, wherein said casing comprises internally deflecting means of the flow of the second operating fluid arranged transversally with respect to said longitudinal direction.

4. The heat exchanger according to claim 3, wherein said deflecting means comprises a plate element provided with a plurality of first openings configured to be crossed by said tube bundle.

5. The heat exchanger according to claim 1, wherein said plate element comprises a plurality of second openings configured to allow a crossing of the second operating fluid in substantially liquid form.

6. The heat exchanger according to claim 3, wherein said deflecting means occupies a circular sector of a transversal section of said casing along said longitudinal direction.

7. The heat exchanger according to claim 3, wherein said deflecting means is sequentially arranged along said longitudinal direction in such a way as consecutive deflecting means lies on opposite half-planes with respect to a plane orthogonal to them and passing through said longitudinal direction.

8. The heat exchanger according to claim 1, wherein said shell structure, said casing and said tube bundle are coaxial and have a substantially cylindrical shape.

9. The heat exchanger according to claim 1, comprising supplying means configured to supply said second operating fluid to one or more intermediate levels comprised between longitudinal ends of said tube bundle.

10. The heat exchanger according to claim 1, further comprising a supplying means configured to supply said second operating fluid directly inside said heat exchange chamber.

11. An evaporator being the heat exchanger according to claim 1.

12. The heat exchanger according to claim 1, wherein the perimeter of said outflow opening has an elliptical shape.

* * * * *